US009601296B2

(12) United States Patent
Yang

(10) Patent No.: US 9,601,296 B2
(45) Date of Patent: Mar. 21, 2017

(54) LOW TRIPPING LEVEL CIRCUIT BREAKERS, TRIPPING UNITS, AND METHODS

(71) Applicant: Guang Yang, Suwanee, GA (US)

(72) Inventor: Guang Yang, Suwanee, GA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 659 days.

(21) Appl. No.: 13/768,014

(22) Filed: Feb. 15, 2013

(65) Prior Publication Data

US 2013/0271257 A1 Oct. 17, 2013

Related U.S. Application Data

(60) Provisional application No. 61/623,679, filed on Apr. 13, 2012.

(51) Int. Cl.

| | |
|---|---|
| ***H01H 77/04*** | (2006.01) |
| ***H01H 71/16*** | (2006.01) |
| ***H01H 71/32*** | (2006.01) |
| *H01H 71/40* | (2006.01) |

(52) U.S. Cl.

CPC ..... *H01H 77/04* (2013.01); *H01H 71/16* (2013.01); *H01H 71/323* (2013.01); *H01H 71/164* (2013.01); *H01H 71/40* (2013.01)

(58) Field of Classification Search

CPC ..... H01H 77/04; H01H 71/16; H01H 71/323; H01H 71/40; H01H 71/164

USPC ..... 337/37, 70, 73

See application file for complete search history.

(56) References Cited

U.S. PATENT DOCUMENTS 2,140,362 A * 12/1938 Kintzing ..... H01H 71/40 335/36
2,573,307 A * 10/1951 Casey ..... H01H 71/7436 200/286
2,740,864 A * 4/1956 Tsai ..... H01H 37/12 337/375
2,813,167 A * 11/1957 Bingenheimer ..... H01H 71/405 335/145
3,264,435 A 8/1966 Klein (Continued)

FOREIGN PATENT DOCUMENTS

EP 0954002 A2 11/1999

OTHER PUBLICATIONS

PCT International Search Report mailed Jun. 27, 2013 corresponding to PCT International Application No. PCT/US2013/033214 filed Mar. 21, 2013 (12 pages).

*Primary Examiner* — Anatoly Vortman

(57) ABSTRACT

Embodiments provide a circuit breaker having a relatively low instantaneous current level at tripping. The circuit breaker includes a tripping mechanism coupled to a moveable electrical contact, the tripping mechanism including a tripping unit having a magnet, a bimetal member extending alongside of the magnet and having a moveable end, and an armature including an engagement portion being moveable as a result of motion the moveable end to trip the circuit breaker upon exceeding an instantaneous current level, and either the armature or the bimetal member includes a non-magnetic separating piece preventing a magnetic short circuit. System and method aspects are provided, as are other aspects.

11 Claims, 11 Drawing Sheets

(56) References Cited

U.S. PATENT DOCUMENTS

| | | | | | |
|---|---|---|---|---|---|
| 3,703,691 | A * | 11/1972 | Gryctko | H01H 83/20 | 335/172 |
| 5,329,264 | A * | 7/1994 | Toda | H01H 71/405 | 335/35 |
| 6,803,850 | B2 * | 10/2004 | Richter | H01H 71/164 | 335/35 |
| 7,518,482 | B2 * | 4/2009 | Fleege | H01H 71/16 | 337/36 |
| 2004/0150504 | A1 * | 8/2004 | Nicholson | H01H 37/58 | 337/54 |

* cited by examiner

LOW TRIPPING LEVEL CIRCUIT BREAKERS, TRIPPING UNITS, AND METHODS

RELATED APPLICATION

This application claims priority to U.S. Provisional Application Ser. No. 61/623,679 entitled "CIRCUIT BREAKER TRIPPING UNIT WITH LOW TRIPPING LEVEL" filed on Apr. 13, 2012, the disclosure of which is hereby incorporated by reference in its entirety herein.

FIELD

The present invention relates generally to circuit breakers for interrupting current from an electrical power supply, and more particularly to tripping mechanisms for circuit breakers.

BACKGROUND

Circuit breakers are used in certain electrical systems for protecting an electrical circuit (hereinafter "protected circuit") coupled to an electrical power supply. For example, circuit breakers may be conventional mechanical-type circuit breakers or electronic circuit breakers. Examples of electronic circuit breakers are ground fault circuit interrupters (GFCI) or arc fault circuit interrupters (AFCI). Both conventional mechanical and electronic circuit breakers (e.g., GFCIs and AFCIs) include tripping mechanisms that may provide persistent over-current protection as well as short circuit protection, and may provide for hand circuit breaker tripping as well. Although electronic circuit breakers (e.g., GFCI's and AFCI's) include an internal printed circuit board, which together with one or more onboard sensors may detect changes in an electrical condition within the protected circuit and trip a tripping mechanism, they also commonly include a tripping mechanism that has a bimetal element and armature adapted to passively trip the circuit breaker. During a current overload condition, the bimetal will bend and trip the armature.

Although constructions of such conventional circuit breaker tip mechanisms do allow for tripping at relatively low current thresholds, (at so-called low "instantaneous levels"), this has been at the expense of making certain components larger (e.g., magnets). Achieving instantaneous levels of about eight times their handle rating or less his has been an elusive goal for circuit breaker designers (e.g., 160 A for a 20 A breaker; 120 A for a 15 A breaker), especially in conventionally-sized components.

Accordingly, there is a long-felt and unmet need for a circuit breaker having low trip thresholds and small size.

SUMMARY

In a first aspect, a circuit breaker is provided. The circuit breaker includes a housing containing a moveable electrical contact and a tripping mechanism coupled to a moveable electrical contact, the tripping mechanism including a tripping unit. The tripping unit has a magnet, a bimetal member extending alongside of the magnet and including a moveable end, and an armature including an engagement portion being moveable by motion of the moveable end of the bimetal member to trip the circuit breaker upon exceeding an instantaneous current level. The armature or the bimetal member includes a non-magnetic separating piece preventing a magnetic short circuit between the moveable end and the armature.

In another aspect, a tripping unit of a circuit breaker is provided. The tripping unit includes a magnet, a bimetal member extending alongside of the magnet, the bimetal member having a moveable end, and a non-magnetic spacer provided on a surface of the bimetal member at the moveable end.

In another aspect, a tripping unit of a circuit breaker is provided. The tripping unit includes a magnet, a bimetal member extending alongside of the magnet, the bimetal member having a moveable end, and an armature including an engagement portion being moveable by motion of the moveable end of the bimetal member and operable to trip the circuit breaker upon exceeding an instantaneous current level, wherein the armature or the bimetal member includes a non-magnetic separating piece preventing a magnetic short circuit between the moveable end and the armature.

In another aspect, a method of tripping a circuit breaker is provided. The method includes providing a trip unit having a magnet, a bimetal member extending alongside of the magnet, the bimetal member having a moveable end, and an armature including an engagement portion being moveable by motion of the moveable end, and preventing a magnetic short circuit between the moveable end and the armature upon exceeding a threshold current.

Still other aspects, features, and advantages of the present invention may be readily apparent from the following detailed description by illustrating a number of example embodiments and implementations, including the best mode contemplated for carrying out the present invention. The present invention may also be capable of other and different embodiments, and its several details may be modified in various respects, all without departing from the scope of the present invention. Accordingly, the drawings and descriptions are to be regarded as illustrative in nature, and not as restrictive. The drawings are not necessarily drawn to scale. Like numerals are used throughout to denote like elements. The invention is to cover all modifications, equivalents, and alternatives falling within the scope of the invention.

DETAILED DESCRIPTION

Residential circuit breakers, for example, interrupt a protected electrical circuit automatically under certain circuit fault conditions. There are three general categories of circuit fault conditions: short circuit, persistent current overload, and electronically detected. The short circuit condition is a fault condition where a high current runs from the line side to the load side of the circuit breaker. Normally, when the current through the circuit breaker is higher than eight times the circuit breaker handle rating, it is considered short circuit. Residential circuit breakers (e.g., 15 A and 20 A circuit breakers) in the US normally use a trip unit with a bimetal member, magnet, and an armature, which is activated when high current runs through the bimetal to delatch a trip mechanism. The persistent current overload condition is a fault condition where the current running through the circuit breaker is only mildly higher than the breaker handle rating, such as current slightly less than eight times the handle rating. Under this condition, most residential circuit breakers use a bimetal to trip and interrupt the circuit. Bimetal members heat up and bend when such a persistent overload current runs through them, and thus can be used to de-latch the tripping mechanism. Electronic detected fault conditions are normally detected with electronic components that are not in the circuit breaker current path. Examples of such conditions include arc fault and ground fault, which are detected by AFCIs and GFCIs, respectively. Once such faults are detected, the detecting circuits normally activate an actuator, such as a solenoid or electromagnet, which acts on the armature to de-latch the tripping mechanism.

For circuit breakers having low handle ratings, such as 15 A or 20 A handle ratings, the threshold for a short circuit condition is quite low. It is desired that the tripping unit will work at eight times the handle rating or less, which are 120 A for 15 A handle rating breakers and 160 A for 20 A handle rating breakers. When using a common magnet design (e.g., a U-shaped steel member) of the prior art, when the current reaches the so-called "instantaneous level" the magnet is magnetized and attracts the armature of the circuit breaker to de-latch the tripping mechanism. Getting the instantaneous current level down to 120 A (for a 15 A) to 160 A (for a 20 A) is a challenge to breaker designers. Common existing solutions include increasing the size of the magnet, which makes compact design more difficult, and putting an extra turn of current around the magnet, which is difficult for manufacturing. Embodiments of the present invention provide a tripping unit utilizing the simple U-shape magnet, but which may provide a lower instantaneous current level.

Figure 2:
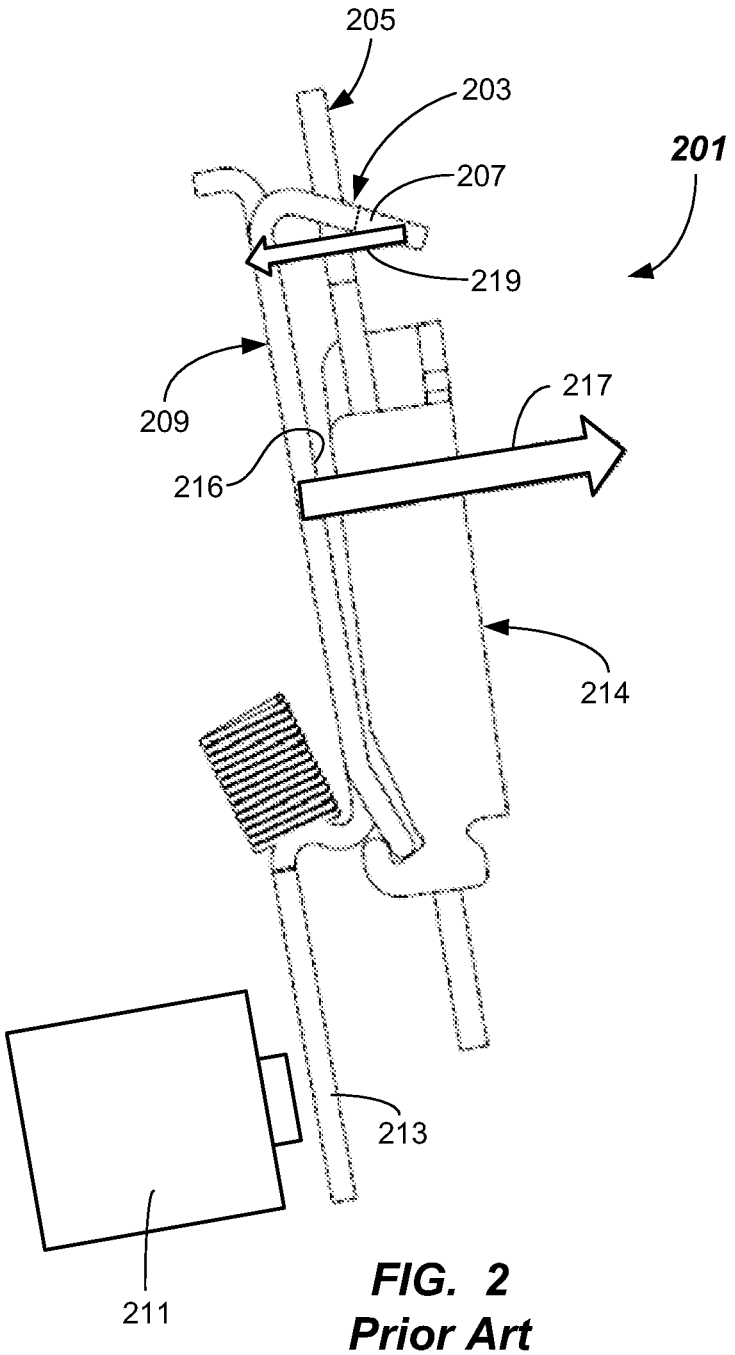
FIG. 2 Prior Art
FIG. 2 is a side view illustrating magnetic forces acting on a conventional tripping unit according to the prior art.

In particular, as shown in FIG. 2, for a prior art tripping unit 201 of a 15 A or 20 A circuit breaker, the gap 203 between the bimetal 205 and the engagement portion 207 of the armature 209 (e.g., the hook) of a conventional tripping unit 201 can be low or zero. Since the armature 209 is made of ferromagnetic material, such as steel, during an electronically-detected condition, an electromagnet 211 is used to attract a surface 213 of the armature to delatch a cradle coupled to the moving electrical contact. During a short circuit condition, high current passes through the bimetal 205, and magnet 214, which is also made of ferromagnetic material, is energized and attracts the magnet surface 216 of the armature to delatch the cradle via a primary latch force 217. However, the inventor herein discovered that the primary delatch force 217 is opposed by an opposing force 219 acting on the armature 209 also exists during such condition. This force 219, although lower in magnitude than the delatch force 217, acts at a larger radius from the pivot and can thus raise the instantaneous trip level.

The low expansion side of the bimetal 205, is normally made of iron or other ferromagnetic material, and faces the engagement portion. Therefore, when current passes through the bimetal 205, the low expansion side magnetically attracts the engagement portion 207, and creates a force that works against delatching the cradle. This opposing force 219 reaches a highest value when the bimetal 205 physically touches the engagement portion 207, as a magnetic short circuit is created. A touching condition normally happens for conventional 15 A and 20 A circuit breakers, because the smaller starting gap 203 that is used and the higher reacting rate of the bimetal 205.

In view of the foregoing difficulties, there is a need for a circuit breaker and tripping unit, which can trip at a very low instantaneous current level. Accordingly, embodiments of the present invention provide an improved circuit breaker and circuit breaker tripping unit. In accordance with one aspect, a circuit breaker is provided that includes an improved tripping unit. The circuit breaker includes a housing containing a moveable electrical contact; and a tripping mechanism coupled to a moveable electrical contact, the tripping mechanism including an improved tripping unit having a magnet, a bimetal member extending alongside of the magnet with a moveable end, and an armature including an engagement portion being moveable by motion of the moveable end to trip the circuit breaker upon exceeding an instantaneous current level. In order to improve the instantaneous current level, the armature or the bimetal member includes a non-magnetic separating piece. The non-magnetic separating piece prevents a magnetic short circuit between the moveable end and the armature and thus minimizes the opposing force. In some embodiments, the non-magnetic separating piece may be provided by applying direct insulation between the bimetal and the engaging portion of the armature. The insulation is made of non-magnetic material, such as brass or plastics, and can be directly attached to either the engaging portion or the bimetal.

In other embodiments, the entire engagement portion may comprise a non-magnetic separating piece. In particular, the entire engagement portion may be a separate piece of non-magnetic material, which is attached to the rest of the armature such as by welding or other connection method. Thus, embodiments of the present invention provide a means to prevent magnetic short circuit conditions, and hence significantly reduce the opposing force and reduces the instantaneous current level of the circuit breaker.

Embodiments of the present invention are useful in any circuit breaker, such as a single or duplex circuit breaker. Embodiments of the present invention may also be used in electronic circuit breakers, such as those including one or two branches. Other types of circuit breakers including any number of poles or branches may benefit as well.

These and other embodiments of circuit breakers, improved tripping units, and methods of tripping a circuit breaker and tripping unit are described below with reference to FIGS. 1 and 3A-6.

Figure 1:
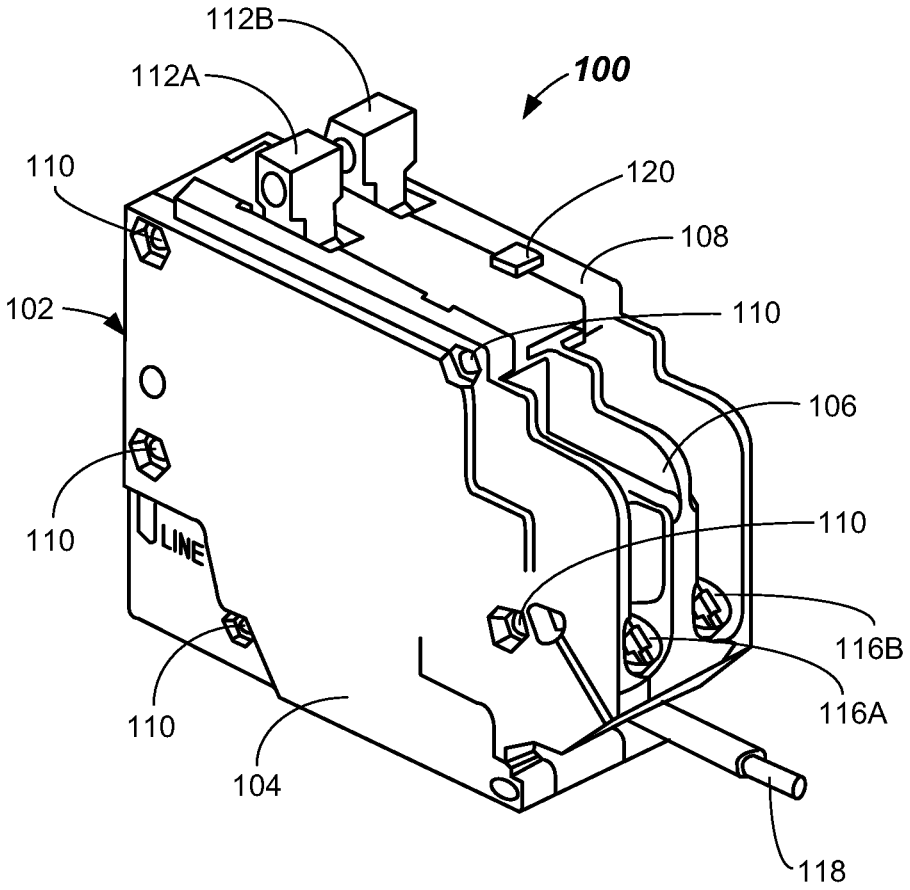
FIG. 1 is a perspective view of a circuit breaker including a tripping mechanism and tripping unit according to embodiments.

Referring now in specific detail to FIG. 1, a circuit breaker 100 containing an improved tripping unit 322 (FIG. 3A) is shown. The circuit breaker 100 includes a breaker housing 102, which may be formed from several housing portions. According to some embodiments, the housing 102 may include any number of suitable housing members, such as two or three interconnected housing portions. In the depicted two-pole embodiment, left housing portion 104, center housing portion 106, and right housing portion 108 may interconnect with each other via multiple connectors 110 (e.g., screws, rivets, or the like) to form the housing 102 and internal spaces and surfaces to contain, mount and retain the other circuit breaker components, which will be further described herein.

The housing portions 104, 106, 108 may be made from any suitable rigid plastic, such as thermoset plastic material (e.g., polyester). Other suitably rigid and insulating materials may be used. Furthermore, other means of fastening the portions together may be used, such as plastic welding or adhesive. Furthermore, a higher or lower number of housing portions may be used to form the housing 102. For example, in a single pole circuit breaker, only two portions may be used.

The circuit breaker 100 may include one or more handles 112A, 112B, one for each electrical branch. The one or more handles 112A and 112B may be used to manually switch the circuit breaker 100. As illustrated, each respective branch of the circuit breaker 100 may be individually switched or tripped. Furthermore, the circuit breaker 100 may include one or more terminals, such as load neutral terminals. In the depicted embodiment, two load neutral terminals 116A, 116B are employed; one associated with each electrical branch. One or more line terminals may be provided (not shown). The circuit breaker 100 may optionally include a pigtail 118, such as a neutral line pigtail adapted to be secured to a panelboard or the like. If the circuit breaker 100 is an electronic circuit breaker, a test button 120 may be included. Although not shown, the two handles 112A, 112B may be tied together with a crossbar or other tying member, such that the switching of one branch switches both branches, for example.

Figure 3A:
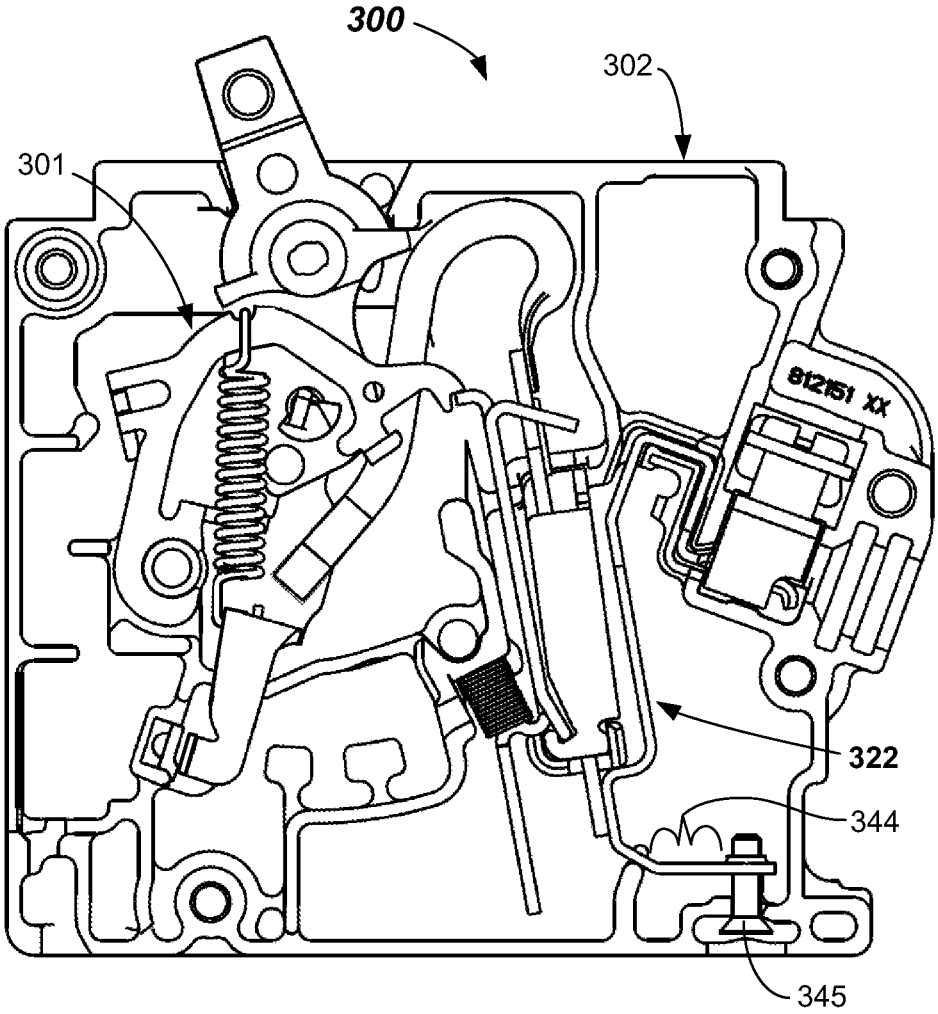
FIG. 3A is a side view illustrating a tripping mechanism and tripping unit in a housing according to embodiments.

Now referring to FIG. 3A, a portion of a circuit breaker 300 is shown illustrating the orientation and connections of the mechanical components thereof. In particular, the circuit breaker 300 includes tripping mechanism 301 within the housing 302. The tripping mechanism 301 includes a tripping unit 322 adapted to interface with the tripping mechanism 301 and thereby trip the circuit breaker 300 upon experiencing an over-current situation. In particular, the tripping unit 322 is operable to trip the circuit breaker 200 upon exceeding an instantaneous current level.

Figure 3B:
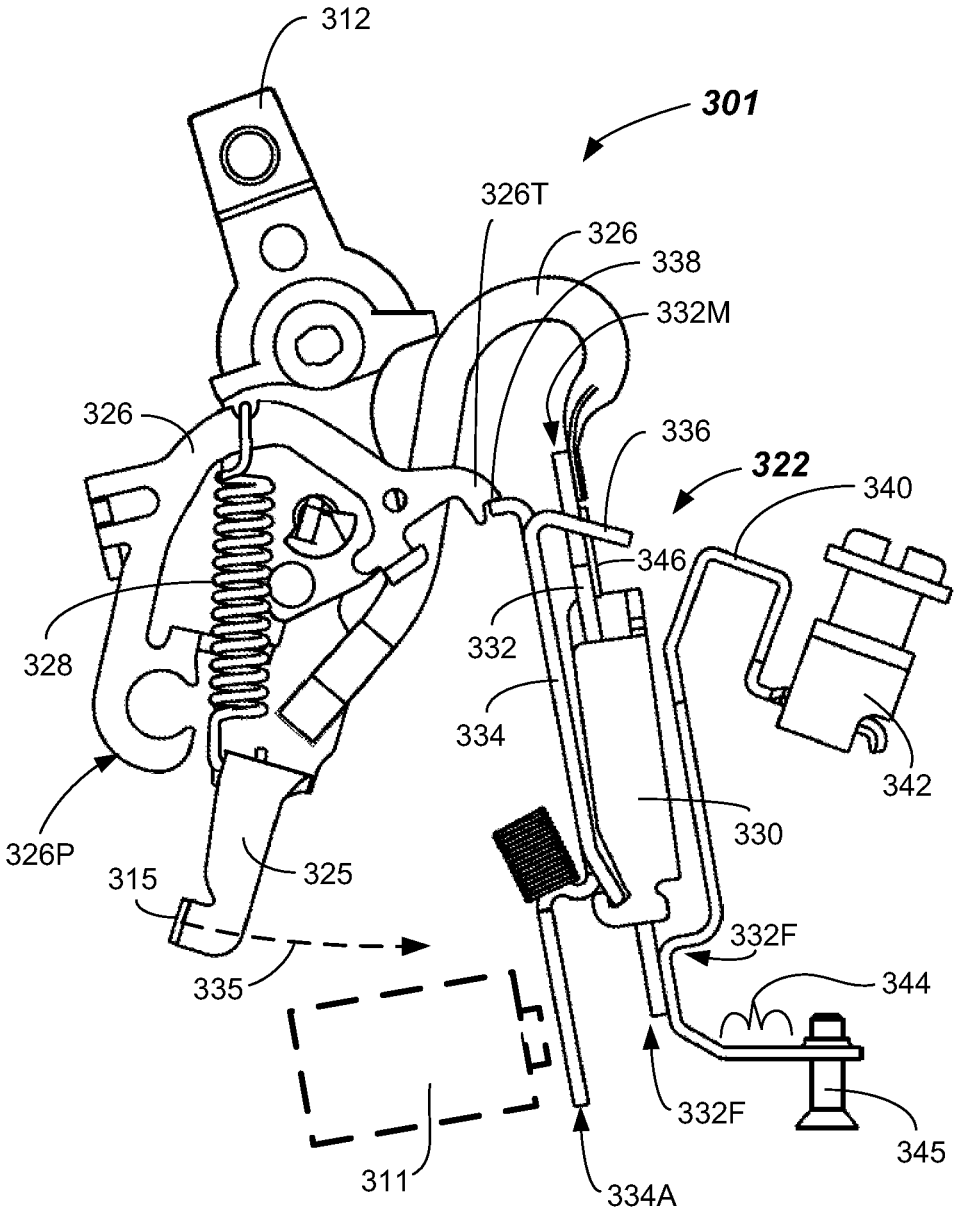
FIG. 3B is a side view illustrating a tripping mechanism and a tripping unit according to embodiments.

Now referring to FIG. 3B, the tripping mechanism 301 and tripping unit 322 are illustrated in isolation. Tripping mechanism 301 includes a moveable contact arm 325 carrying the moveable electrical contact 315, a cradle 326 that is pivotal relative to the housing 302, for example, at a pivot end 326P, a spring 328 coupled to the cradle 326, and a handle 112. The cradle 326 may pivot about a pilot formed on the housing 302 as is conventional.

As depicted, the tripping unit 322 has a magnet 330, a bimetal member 332, and an armature 334. The bimetal member 332 is provided in the current path of an electrical branch, and the tripping unit 322 may detect an over-current condition in the protected circuit and trip the circuit breaker 300 upon exceeding an instantaneous current passing through the bimetal member 332.

Now referring to FIGS. 3A-3F, in one aspect, tripping may be accomplished by hand tripping by a person moving the handle 312 from an ON to an OFF position. Throwing of the handle 312 causes the spring 328 (e.g., a coil spring) to exert a force on the moveable contact arm 325 causing the moveable contact arm 325 to pivot relative to a lower portion of the handle 312 and moves the moveable contact arm 325 along the travel path 335 (shown dotted) to a maximum as-separated condition, i.e., a tripped position.

In more detail, the tripping unit 322 includes the magnet 330 which may be stationarily mounted in the housing 302 and the bimetal member 332 is received alongside of the magnet 330. The bimetal member 332 may have a fixed end 332F and a moveable end 332M at an opposite end thereof. The moveable end 332M is displaceable (in bending) towards the magnet 330. If a short circuit condition is experienced in the protected circuit coupled to the circuit breaker 100, the high current through the bimetal member 332 will cause the magnet 330 to heat up and bend and thereby move the armature 334 and thus trip the tripping mechanism 301 and the circuit breaker 100 by separating the electrical contacts.

During some tripping events, the moveable end 332M of the bimetal member 332 is caused to move the armature 334 thus disengaging a latching surface 338 of the armature 334 from a triggering surface 326T of the cradle 326. In the short circuit instance, the magnetic attraction of the armature 334 to the magnet 330 causes the latching surface 338 of the armature 332 to disengage from the triggering surface 326T of the cradle 326. This trips the circuit breaker 300 and causes the cradle 326 to rotate clockwise about a pivot end 326P and cause separation between the stationary contact and the moving electrical contact 315 by way of the spring 328 exerting a force to cause a counterclockwise rotation of the moveable contact arm 325 and move the moving contact 315 rapidly along the travel path 335.

Figure 3C:
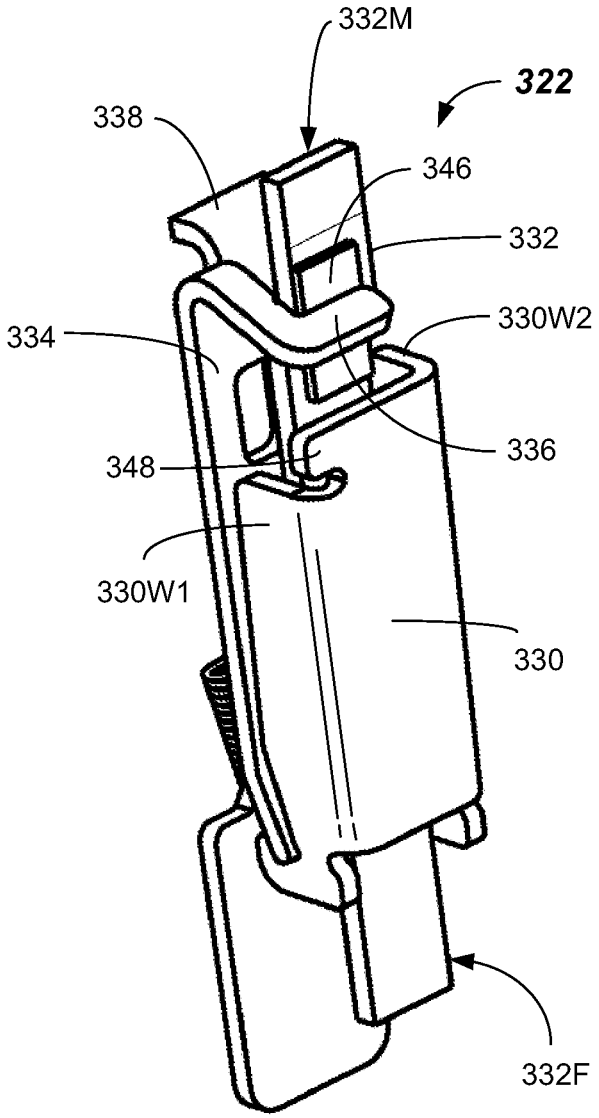
FIG. 3C is a perspective view illustrating a tripping unit according to embodiments.
Figure 3D:
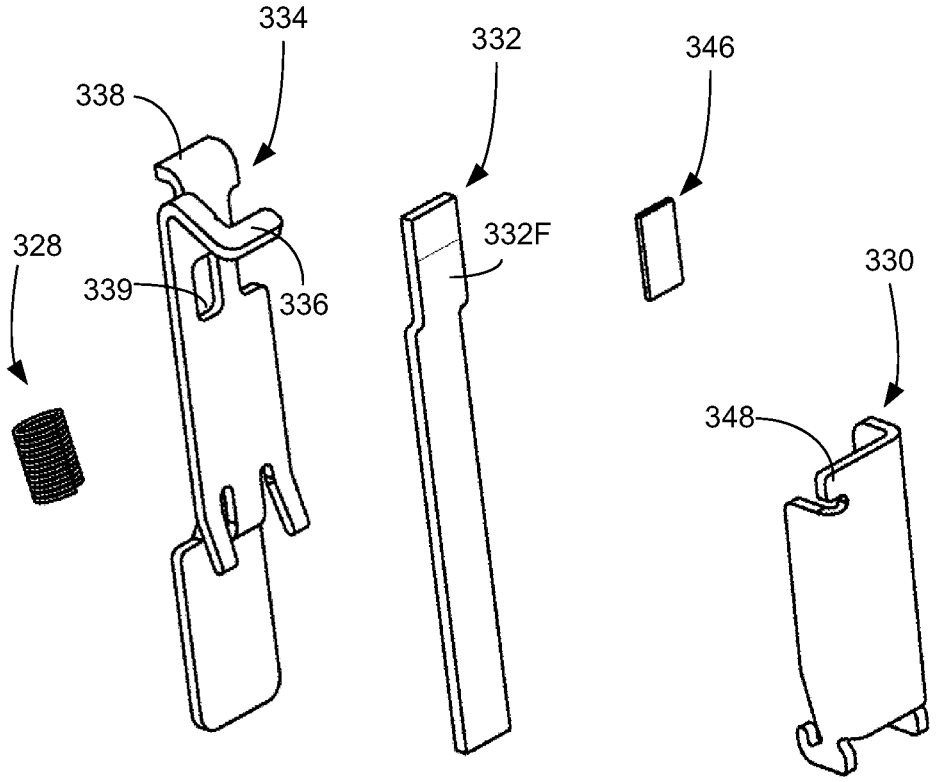
FIG. 3D is an exploded view illustrating various components of a tripping unit according to embodiments.
Figure 3E:
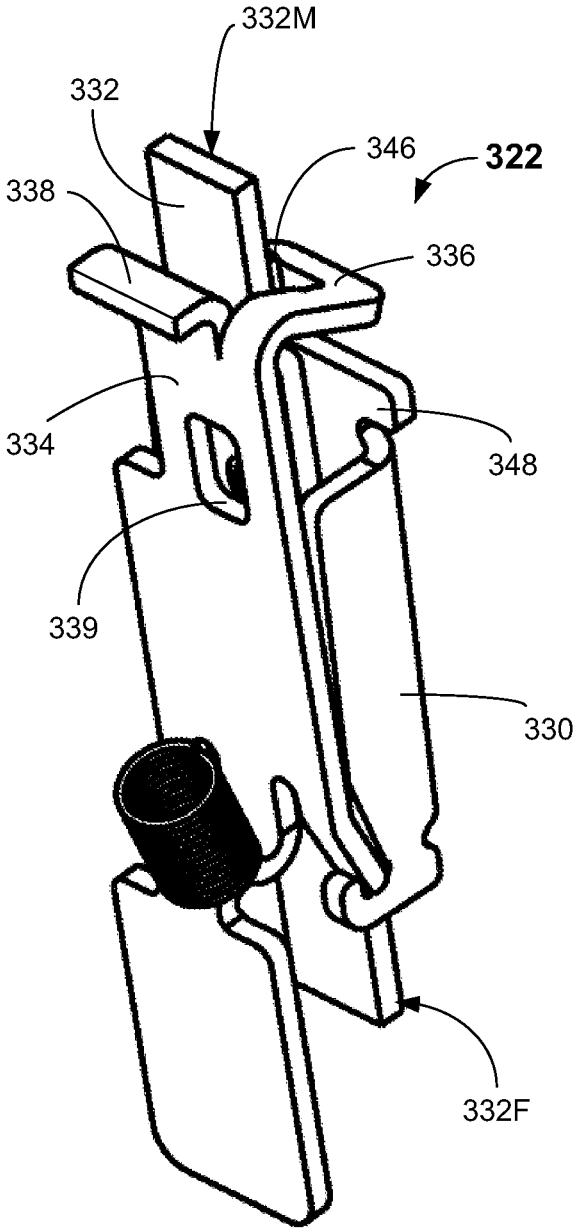
FIG. 3E is a perspective view illustrating a tripping unit according to embodiments.
Figure 3F:
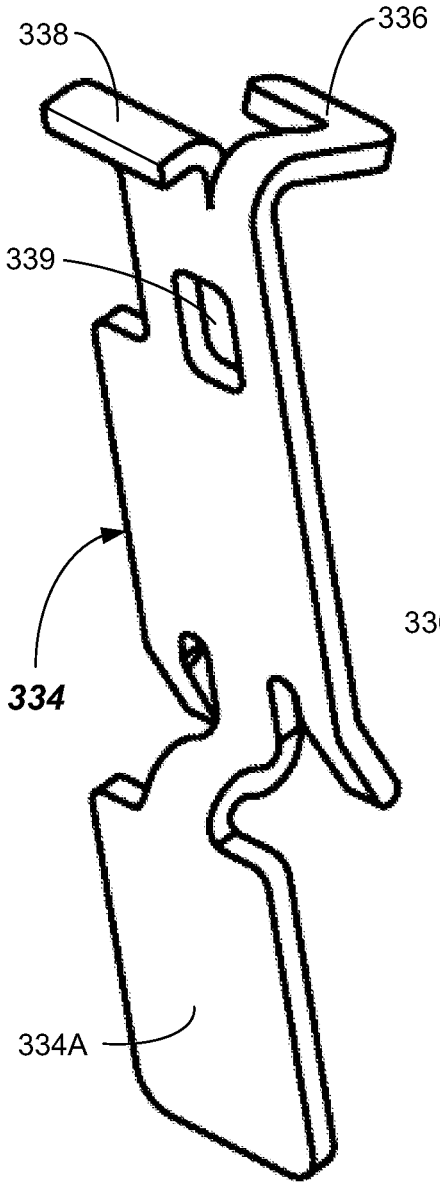
FIG. 3F is a perspective view illustrating an armature according to embodiments.
Figure 3G:
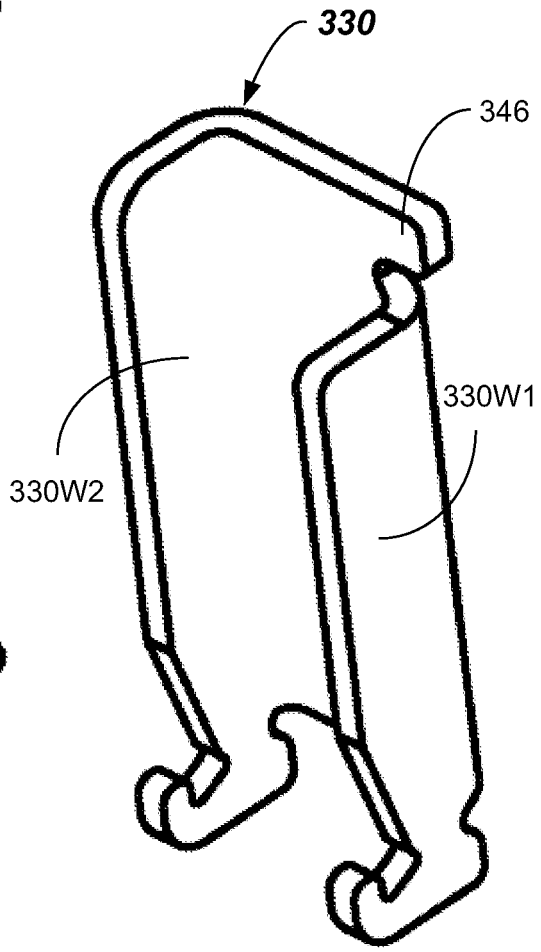
FIG. 3G is a perspective view illustrating a magnet according to embodiments.
Figure 3H:
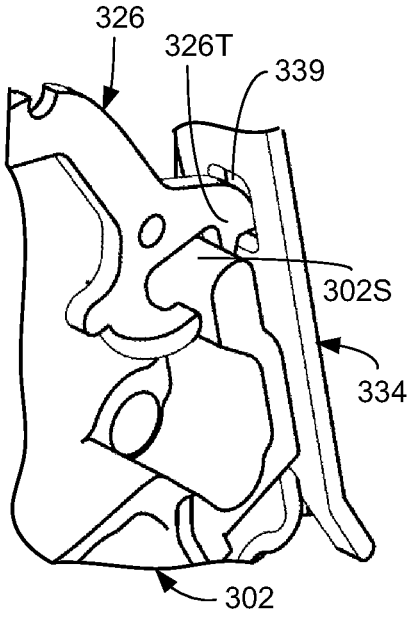
FIG. 3H is an isometric view illustrating a triggering end of the cradle received in an aperture formed in the armature according to embodiments.

Upon tripping, the rotational excursion of the cradle 326 may be limited by coming to rest on a stop feature 302S formed on the housing 302 as shown in FIG. 3H. The triggering end 326T of the cradle 326 may come to be positioned in an aperture 339 formed on the armature 342 upon tripping. In particular, the aperture 339 formed in the body of the armature 334 allows clearance for the triggering end 326T of the cradle 326 to reside therein, thereby allowing the armature 342 and cradle 326 to be moved physically closer to one another. This allows the circuit breaker 300 to be made physically smaller, or allow room for other components.

In yet another instance, tripping of the circuit breaker 300 may be accomplished automatically. In particular, an electronic processing circuit (not shown) in the circuit breaker 300 may determine that an unwanted electrical condition exists in the protected electrical circuit attached to the circuit breaker 300. This may be determined by processing a signal provided from a sensor (not shown) coupled to the electronic processing circuit. The sensor may be provided adjacent to an electrical strap 340 extending between, and electrically connecting, a load terminal 342 that may be coupled to a fixed end 332F end of the bimetal member 332 (FIG. 3B). In the depicted embodiment, the electrical strap 340 is a metal strap, which may be bent at various locations along its length. The electrical strap 340 may have a cross-sectional area, which is rectangular, for example. Other shapes may be provided. The fixed end 332F of the bimetal member 332 may be secured to the electrical strap 340, such as by welding, for example. The electrical strap 340 may also be connected (e.g., welded) to the load terminal 342.

In the depicted embodiment, the electrical strap 340 may extend past the fixed end 332F of the bimetal member 332 and include a cantilevered portion 344 (FIGS. 3A-3B). This cantilevered portion 344 may be contacted by a calibration screw 345 to adjust a position of the bimetal member 332 relative to the armature 334 thereby calibrating the tripping unit 322.

Again referring to the automatically-controlled tripping, upon determining that an unwanted condition exists in the protected circuit (e.g., an arc fault, or a ground fault, or the like), the electronic processing circuit (not shown) may cause an actuator 311 to move the armature 334. For example, the armature 334 may be moved at an actuation end 334A thereof, and cause a disengagement of the latching surface 338 from the triggering surface 326T of the cradle 326. This, in the manner previously discussed, separates the electrical contacts from one another and interrupts the protected electrical circuit.

In the depicted embodiment, the actuator 311 may be an electromagnet, which may include a magnetic pole, which, upon energizing the actuator 311, magnetically attracts and moves the armature 334 at the actuation end 334A. In this embodiment, the armature 334 is made from a ferromagnetic material, such as steel. However, any suitable magnetically permeable material may be used. In optional embodiments, the actuator 311 may be a solenoid or other type of actuator, which is adapted to move (e.g., pivot) the armature 334 upon command from the electronic processing circuit (not shown).

Referring again to FIGS. 3B-3F, the tripping unit 322 includes the magnet 330 and the bimetal member 332 received alongside of the magnet 330, and the armature 334. In the depicted embodiment, as shown in FIG. 3C, the bimetal member 332 is received between sidewalls 330W1, 330W2 of the magnet 330. The bimetal member 332 may be generally rectangular in shape as shown in FIG. 3D and may include one or more bends along its length. The bimetal member 332 may include two or more metals with different thermal expansion coefficients. For example, any known material construction of the bimetal member may be used. For example, a combination of steel and nickel may be used. The moveable end 332M of the bimetal member 332 may be displaceable (flexed) towards the magnet 330 responsive to a persistent over-current exposure, which causes a threshold temperature of the bimetal member 332 to be exceeded due to resistive heating of the bimetal member 332. This causes the moveable end 332M of the bimetal member 332 to contact an engagement portion 336 of the armature 334 thereby disengaging the triggering end 326T of the cradle 326 from a latching surface 338 of the armature 334. In turn, this causes rotation of the cradle 326, tripping of the circuit breaker, and movement of the contact arm 325 and moveable electrical contact 215 along the travel path 335 thereby separating the moveable electrical contact 315 from a stationary contact (not shown).

In the case of a short circuit being experienced (e.g., current) in the protected circuit, a high current flows through the bimetal member 332. This induces a magnetic field in the magnet 330 which causes the armature 334 be attracted to the sidewalls 330W1, 330W2 of the magnet 330. In the depicted embodiment, the armature 334 pivots on the magnet 330. This motion disengages the latching surface 338 of the armature 334 from the triggering end 326T of the cradle 326 and trips the circuit breaker 300.

In the depicted embodiment, the bimetal member 332 has a non-magnetic separating piece 346 provided on a surface thereby preventing a magnetic short circuit between the moveable end 332M of the bimetal member 332 and the armature 334, and in particular, between the engagement portion 336 (e.g., hook) and the bimetal member 332. The non-magnetic separating piece 346 may be any type of non-magnetic insulating material. For example, the non-magnetic separating piece 346 may be a spacer made of copper, aluminum, brass or an insulating material, such as plastic or piezoelectric tape. The non-magnetic separating piece may be provided between the engagement portion 336 and a ferromagnetic side 332F of the bimetal member 332. The non-magnetic separating piece 346 may have a thickness of between about 0.005 inch (0.127 mm) and about 0.05 inch (1.27 mm). The non-magnetic separating piece 346 may have a width that is about a same width as the bimetal member 332, and a length of about 0.2 inch (about 5 mm) in some embodiments. Other dimensions may be used. The non-magnetic separating piece 346 ensures that the engagement portion 336 never physically touches the bimetal member 332.

In addition to the non-magnetic separating piece 346, the trip unit 322 may include a tab 348 that is adapted to be received in a pocket formed in the housing 102 to further secure and stabilize the positioning of the magnet 330 in the housing 102.

Figure 4:
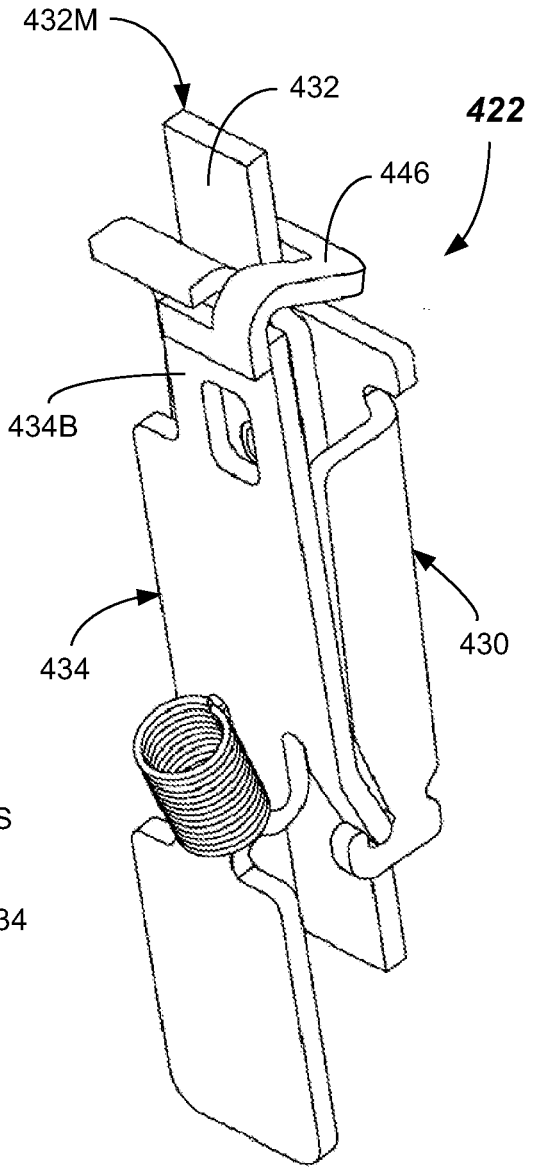
FIG. 4 is a perspective view illustrating another tripping unit according to embodiments.

FIG. 4 illustrates another embodiment of a tripping unit 422. In this embodiment including a magnet 430, a bimetal member 432, and armature 434, the non-magnetic separating piece 446 comprises a separate piece that is affixed to the body 434B of the armature 434. The non-magnetic separating piece 446 may be welded, braised or physically attached by fasteners to the body 434B. Other connection means may be used. The non-magnetic separating piece 446 may be copper, brass, aluminum, or non-magnetic rigid material.

Figure 5A:
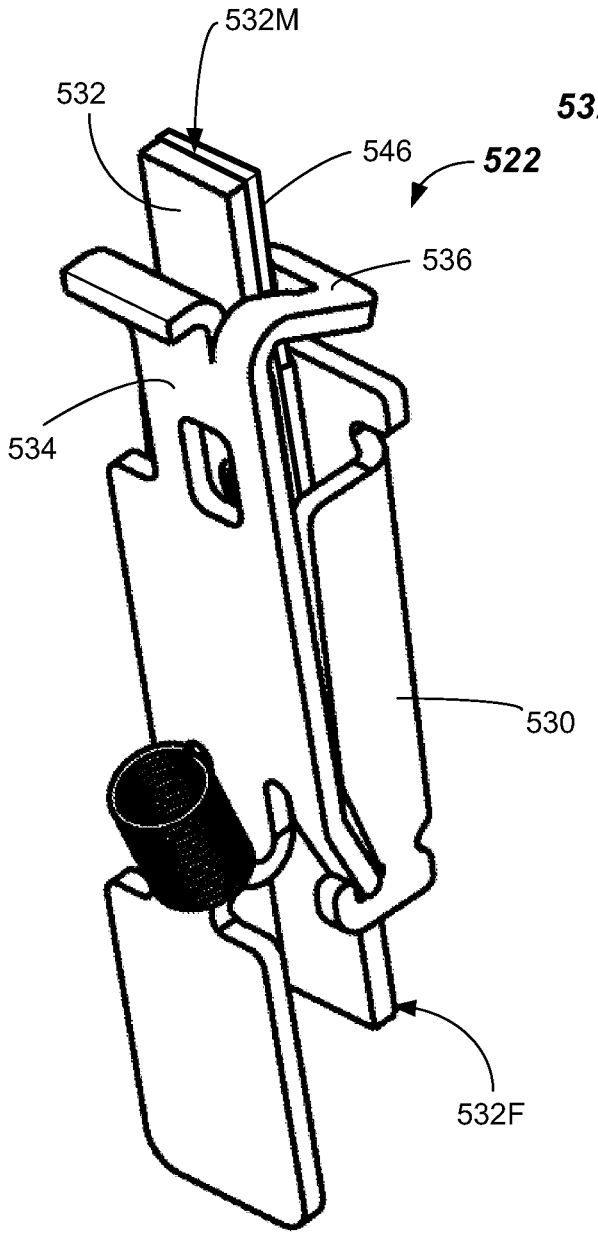
FIG. 5A is a perspective view illustrating another tripping unit according to embodiments.
Figure 5B:
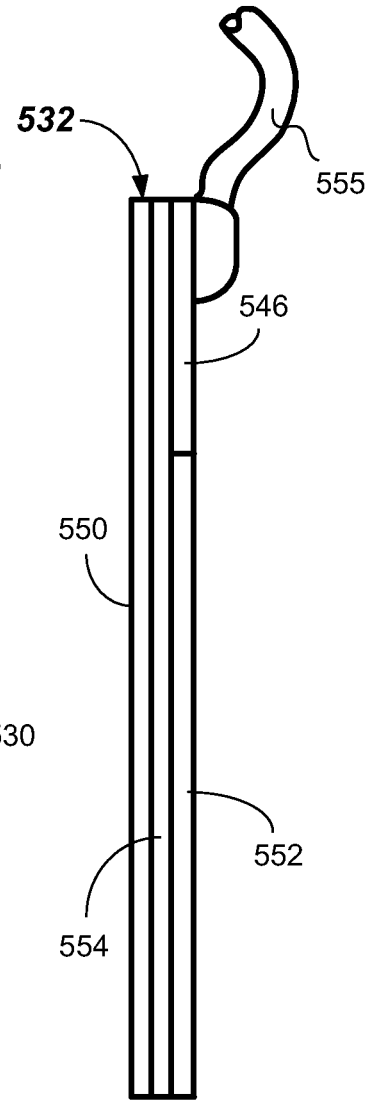
FIG. 5B is a side view illustrating a bimetal member and an attached separating piece according to embodiments.

FIG. 5A-5B illustrates yet another embodiment of a tripping unit 522. In this embodiment including a magnet 530, a bimetal member 532, and armature 534, the non-magnetic separating piece 546 comprises a separate piece that is affixed to the bimetal member 532 near the moveable end 532M thereof. The non-magnetic separating piece 546 may be welded, braised, or physically attached by fasteners to the bimetal member 532. The non-magnetic separating piece 446 may be copper, brass, aluminum, or non-magnetic rigid material. In particular, as best shown in side view FIG. 5B, the bimetal member 532 includes a first layer 550, a second layer 552 which is shorter in length than the first layer 550. The bimetal member 532 may include an intermediate layer 554, which may be provided between the first layer 550 and the second layer 552 at least along a portion of the length of the bimetal member 532. The non-magnetic separating piece 546 may be a same thickness as a thickness of the second layer 552, for example. The non-magnetic separating piece 546 may extend from an end of the second layer 552 to an end of the first layer 550. In some embodiments, the non-magnetic separating piece 446 may have a flexible braided electrical connector 555 secured thereto, such as by braising, welding, or soldering or the like. The flexible connector 555 is adapted to connect to the moveable contact arm (e.g., like moveable contact arm 325). Thus, in this embodiment, the non-magnetic separating piece 546 comprises an end segment of non-magnetic material coupled to the moveable end 532M of the bimetal member 532.

Figure 6:
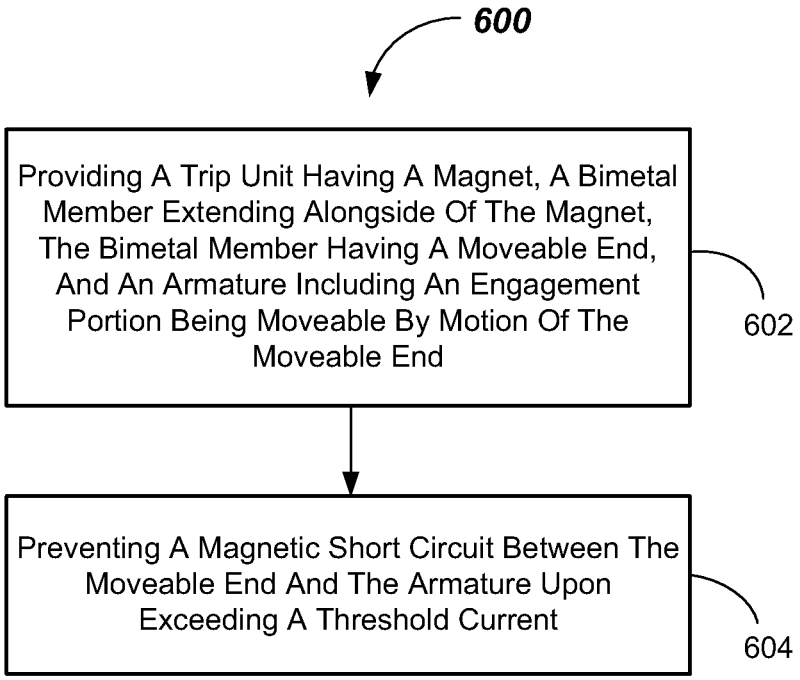
FIG. 6 is a flowchart illustrating a method of tripping a circuit breaker according to embodiments.

FIG. 6 is a flowchart illustrating a method of tripping a circuit breaker according to one or more embodiments of the present invention. The method 600 includes, in 602, providing a trip unit (e.g., trip unit 322, 422, 522) having a magnet (e.g., magnet 330, 430, 530), a bimetal member (e.g., bimetal member 332, 432, 532) extending alongside of the magnet, the bimetal member having a moveable end (e.g., moveable end 332M, 432M, 532M), and an armature (e.g., armature 334, 434, 534) including an engagement portion (e.g., engagement portion 336, 436, 536) being moveable by motion of the moveable end, and, in 604, preventing a magnetic short circuit between the moveable end and the armature upon exceeding a threshold current. In other words, direct contact between the moveable end 332M, 432M, 532M and the armature is avoided by including the non-magnetic separating piece (e.g., 346, 446, and 546) during short circuit conditions. By utilizing the non-magnetic separating piece (e.g., 346, 446, and 546) in the tripping unit (e.g., 322, 422, and 522), the tripping unit (e.g., 322, 422, and 522) separates the main electrical contacts through magnetic tripping at a relatively lower current level.

In some embodiments, the circuit breaker (e.g., 200) including the tripping unit (e.g., tripping unit 322, 422, 522) has a 15 A handle rating and trips at an instantaneous current level of less than about 180 A. In some embodiments, the circuit breaker (e.g., 200) including the tripping unit (e.g., tripping unit 322, 422, 522) has a 15 A handle rating and trips at an instantaneous current level of between about 120 A and about 180 A. In other embodiments, the circuit breaker (e.g., 200) including the tripping unit (e.g., tripping unit 322, 422, 522) has a 20 A handle rating and trips at an instantaneous current level of less than about 200 A. In some embodiments, the circuit breaker (e.g., 200) including the tripping unit (e.g., tripping unit 322, 422, 522) has a 20 A handle rating and trips at an instantaneous current level of between about 160 A and about 200 A.

While the invention is susceptible to various modifications and alternative forms, specific embodiments and methods thereof have been shown by way of example in the drawings and are described in detail herein. It should be understood, however, that it is not intended to limit the invention to the particular apparatus, systems or methods disclosed, but, to the contrary, the intention is to cover all modifications, equivalents and alternatives falling within the scope of the invention.

What is claimed is:

1. A circuit breaker comprising a housing containing a moveable electrical contact; and a tripping mechanism coupled to a moveable electrical contact, the tripping mechanism including a tripping unit having a magnet, a bimetal member extending alongside of the magnet and including a moveable end, and an armature including an engagement portion being moveable by motion of the moveable end of the bimetal member to trip the circuit breaker upon exceeding an instantaneous current level and wherein the tripping mechanism comprises a cradle having a triggering end engageable with a latching surface of the armature of the tripping unit, and an aperture formed in a body of the armature wherein the aperture is configured to receive the triggering end therein upon tripping, wherein: the armature or the bimetal member includes a non-magnetic separating piece preventing a magnetic short circuit between the moveable end and the armature.

2. The circuit breaker of claim 1, wherein the non-magnetic separating piece comprises a spacer of a non-magnetic material provided on a surface of the bimetal member.

3. The circuit breaker of claim 2, wherein the non-magnetic separating piece is provided between the engagement portion and a ferromagnetic side of the bimetal member.

4. The circuit breaker of claim 2, wherein the non-magnetic separating piece is made of a material selected from a group of copper, brass, and aluminum.

5. The circuit breaker of claim 2, wherein the non-magnetic separating piece is made of a plastic material.

6. The circuit breaker of claim 2, wherein the non-magnetic separating piece is made of a piezoelectric material.

7. The circuit breaker of claim 2, wherein the non-magnetic separating piece has a thickness of between about 0.127 mm and about 1.27 mm.

8. The circuit breaker of claim 1, wherein the circuit breaker has a 15 A handle rating and trips at an instantaneous current level of less than about 120 A.

9. The circuit breaker of claim 8, wherein the circuit breaker trips at an instantaneous current level of between about 120 A and about 180 A.

10. The circuit breaker of claim 1, wherein the circuit breaker has a 20 A handle rating and trips at an instantaneous current level of less than about 160 A.

11. The circuit breaker of claim 10, wherein the circuit breaker trips at an instantaneous current level of between about 160 A and about 200 A.

* * * * *